US011412778B2

(12) United States Patent
Cieslikowski et al.

(10) Patent No.: US 11,412,778 B2
(45) Date of Patent: Aug. 16, 2022

(54) FEEDING DEVICE FOR FEEDING A CONTINUOUS STRIP INTO A CONTINUOUS FIBROUS BAND IN A TOBACCO INDUSTRY MACHINE FOR MANUFACTURING ROD-LIKE ELEMENTS AND A MACHINE FOR MANUFACTURING ROD-LIKE ELEMENTS

(71) Applicant: International Tobacco Machinery Poland Sp. z o.o., Radom (PL)

(72) Inventors: Bartosz Cieslikowski, Przysucha (PL); Andrzej Lisowski, Kielce (PL)

(73) Assignee: INTERNATIONAL TOBACCO MACHINERY Poland Sp. z o.o., Radom (PL)

( * ) Notice: Subject to any disclaimer, the term of this patent is extended or adjusted under 35 U.S.C. 154(b) by 234 days.

(21) Appl. No.: 16/462,167

(22) PCT Filed: Nov. 15, 2017

(86) PCT No.: PCT/EP2017/079239

§ 371 (c)(1),
(2) Date: May 17, 2019

(87) PCT Pub. No.: WO2018/091483

PCT Pub. Date: May 24, 2018

(65) Prior Publication Data

US 2019/0328035 A1 Oct. 31, 2019

(30) Foreign Application Priority Data

Nov. 19, 2016 (PL) ..... 419518

(51) Int. Cl.
*A24D 3/02* (2006.01)

(52) U.S. Cl.
CPC ..... *A24D 3/0212* (2013.01); *A24D 3/0233* (2013.01); *A24D 3/0254* (2013.01)

(58) Field of Classification Search
CPC .. A24D 3/0212; A24D 3/0254; A24D 3/0233; A24D 3/061; A24D 3/0216
See application file for complete search history.

(56) References Cited

U.S. PATENT DOCUMENTS 3,518,999 A * 7/1970 Milner ..... A24C 5/471 131/94
4,103,596 A * 8/1978 Molins ..... A24C 5/471 493/39

(Continued)

FOREIGN PATENT DOCUMENTS

DE 102006025738 B3 11/2007
EP 2606755 A1 6/2013

(Continued)

OTHER PUBLICATIONS

International Search Report and Written Opinion of the International Searching Authority in WO/2018/091483 (PCT/EP2017/079239).

*Primary Examiner* — Andrew M Tecco
*Assistant Examiner* — Nicholas E Igbokwe
(74) *Attorney, Agent, or Firm* — Soody Tronson; STLG Law Firm

(57) ABSTRACT

A feeding device (8, 8', 8'', 8''') for feeding a continuous strip (9) into a continuous fibrous band, in a tobacco industry machine for manufacturing rod-like elements, wherein the fibrous band is formed to a form of a continuous rod (CR) comprising the continuous strip (9) surrounded by the continuous fibrous band, the feeding device (8, 8', 8'', 8''') comprising: a strip supply unit (10) for feeding the continuous strip (9); a strip feeding unit (11) for feeding the continuous strip (9) into the middle of the continuous fibrous band; wherein the feeding device (8, 8', 8'', 8''') is configured such that the strip feeding unit (11) is located in the machine for manufacturing the rod-like elements between a fibrous band preparation unit (4) and a garniture unit (15) for forming the continuous rod. The feeding device (8, 8', 8'', 8''') further comprises: a feeding wheel (7), having a circumferential surface (20) comprising a cylindrical guiding surface (20A) for guiding the continuous strip (9); and (Continued)

guiding surfaces (21A; 22A; 31A; 32A; 41A; 42A; 51A; 52A). The guiding surfaces (21A; 22A; 31A; 32A; 41A; 42A; 51A; 52A) and the cylindrical guiding surface (20A) form a duct for guiding the continuous strip (9).

20 Claims, 7 Drawing Sheets

(56) References Cited

U.S. PATENT DOCUMENTS

| | | | | | |
|---|---|---|---|---|---|
| 4,412,829 | A * | 11/1983 | Lebet | A24D 3/0225 | 141/71 |
| 4,862,905 | A * | 9/1989 | Green, Jr. | A24D 3/0216 | 131/84.1 |
| 6,723,033 | B1 * | 4/2004 | Scott | A24D 3/0212 | 493/48 |
| 2012/0077659 | A1 * | 3/2012 | Yanchev | A24D 3/0287 | 493/39 |
| 2014/0209111 | A1 | 7/2014 | Russell | | |

FOREIGN PATENT DOCUMENTS

| | | | | |
|---|---|---|---|---|
| WO | WO/2015/197674 | 12/2015 | | |
| WO | WO 2015/197674 A1 * | 12/2015 | | A24D 3/0212 |

* cited by examiner

FEEDING DEVICE FOR FEEDING A CONTINUOUS STRIP INTO A CONTINUOUS FIBROUS BAND IN A TOBACCO INDUSTRY MACHINE FOR MANUFACTURING ROD-LIKE ELEMENTS AND A MACHINE FOR MANUFACTURING ROD-LIKE ELEMENTS

TECHNICAL FIELD

The present invention relates to a feeding device for feeding a continuous strip into a continuous fibrous band in a tobacco industry machine for manufacturing rod-like elements.

BACKGROUND

Tobacco industry plants manufacture various kinds of smoking products, among others cigarettes. The cigarettes usually comprise filters to filter tobacco smoke and eliminate harmful substances. Typically, acetate fibers are used as a filtering material. The acetate fibers are usually fed in a form of a continuous band. Nowadays, cigarettes often have multi-segment filters, which may comprise different kinds of rod-like segments for filtering tobacco smoke, as well as segments for providing other functions. For example, aromatizing segments may be provided, the aromatizing segments having scent capsules, scent threads or strips, which are usually located in a central portion of segments. The threads or strips may also serve a decorative function, since they are visible at the front surface of the filter. Other segments may be used for directing the stream of tobacco smoke—they may comprise longitudinal, hollow strips forming a flow duct. Therefore, manufacturers have a need for a device for feeding a continuous strip into a continuous fibrous band.

U.S. Pat. Nos. 7,074,170 and 7,691,043 disclose a device for feeding a continuous strip saturated with an aromatic substance, into a continuous filtering material, to form a filter rod which is then cut to single filter rods.

Machines for manufacturing filter rod-like elements, known from the prior art, are typically provided with feeding units which do not guarantee uniform positioning of the fed continuous material. The present invention aims to provide an improved device for feeding a continuous strip for use in machines for manufacturing rod-like elements. The prior art does not comprise devices adapted specifically for inserting a continuous strip into a continuous fibrous band.

SUMMARY

There is disclosed a feeding device for feeding a continuous strip into a continuous fibrous band, in a tobacco industry machine for manufacturing rod-like elements, wherein the fibrous band is formed to a form of a continuous rod comprising the continuous strip surrounded by the continuous fibrous band, the feeding device comprising: a strip supply unit for feeding the continuous strip; a strip feeding unit for feeding the continuous strip into the middle of the continuous fibrous band; wherein the feeding device is configured such that the strip feeding unit is located in the machine for manufacturing the rod-like elements between a fibrous band preparation unit and a garniture unit for forming the continuous rod. The feeding device further comprises: a feeding wheel, having a circumferential surface comprising a cylindrical guiding surface for guiding the continuous strip; and guiding surfaces; wherein the guiding surfaces and the cylindrical guiding surface form a duct for guiding the continuous strip.

The guiding surfaces may have a form of stationary side guiding surfaces positioned at the rotary cylindrical guiding surface.

The stationary side guiding surfaces may be perpendicular to a rotation axis of the feeding wheel.

The stationary side guiding surfaces may be conical.

The circumferential surface of the feeding wheel may have a circumferential groove configured to guide the continuous strip, the circumferential groove comprising the cylindrical guiding surface and the side guiding surfaces.

The device may comprise a side guiding surface in a form of at least one rotary roller located at the rotary cylindrical guiding surface.

The device may comprise a stationary guiding surface in a form of a portion of a cylinder, located in parallel to the cylindrical guiding surface.

There is also disclosed a machine for manufacturing rod-like elements, the machine comprising: a fibrous band supply unit for feeding a continuous fibrous band; a fibrous band preparation unit for preparing the fibrous band; a feeding device for feeding a continuous strip; a wrapper feeding unit for feeding a wrapper; a garniture unit for forming a continuous rod, wherein the continuous rod comprises the fibrous band and the continuous strip and is wrapped by the wrapper; a cutting head for cutting the continuous rod into the rod-like elements, wherein the feeding device is the feeding device as described herein.

The device according to the invention allows positioning a continuous strip in a continuous fibrous band without slipping, wherein the strip is fed synchronically into the fibrous band, i.e. with the speed of transfer of the fibrous band.

BRIEF DESCRIPTION OF FIGURES

The system is shown by means of example embodiments in a drawing, in which:

FIG. 1 shows schematically a machine 1 for manufacturing filter rods R. Fibers of a filtering material, for example acetate fibers in a form of a band that forms the filtering material 2, may be fed by a fibrous band supply unit 17 from a container in a form of a bale 3. The fibers of the filtering material may be compressed in the bale 3. The fibers of the filtering material band 2 are stretched and loosened by means of compressed air and cylinders of a fibrous band preparation unit 4 for preparing a filtering material band. As a result of stretching and loosening, the fibers of the filtering band 2 detach from each other and may accommodate more air in between. In the preparation unit 4, the fibers may be soaked with a softening fluid (for example, triacetin). The machine 1 for manufacturing filter rods R has an inserting element 5 in a form of a funnel, through which the band of the filtering material 2 is passed from the preparation unit 4. While the band of the filtering material 2 passes through the inserting element 5, the fibers are initially compacted. The inserting element 5 may have openings, which facilitate discharging the excess of air from between the fibers of the filtering material band 2. The inserting element 5 is followed by a guiding element 6 for guiding the filtering material band 2, wherein the band is initially formed. The guiding element 6 is configured to cooperate with a feeding wheel 7 of a feeding device 8 for feeding a continuous strip 9 by a strip feeding unit 11, wherein the continuous strip 9 is fed from a strip supply unit 10.

Figure 1:
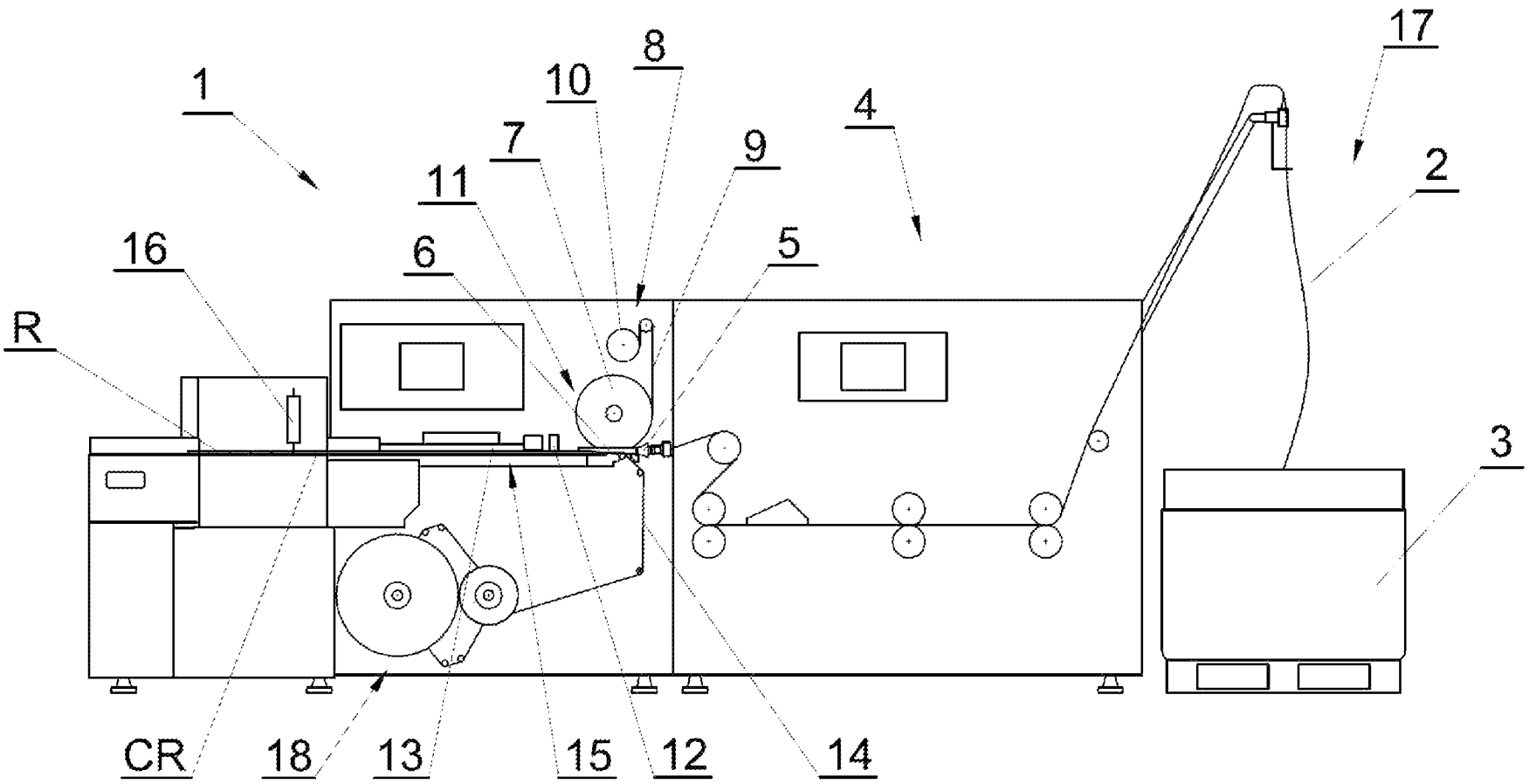
FIG. 1 shows a machine for manufacturing filter rods.

The feeding device 8, in a direction of the filtering material band 2, is followed by a glue feeding unit 12 and a forming unit 13 for winding the band 2 into a wrapper 14. The glue feeding unit 12 and the forming unit 13, which are components of a garniture unit 15, have guides for guiding the wrapper 14. The wrapper 14 is fed by a wrapper feeding unit 18. The machine 1 further comprises a rotary cutting head 16 for cutting a continuous filter rod CR to single filter rods R.

The continuous strip 9 is a material of a cross-section having a width greater than its height. Preferably, the width is at least two times greater than the height. The strip 9 may have a cross-section in a form of a rectangle, a rectangle with rounded corners or an ellipse.

Figure 2:
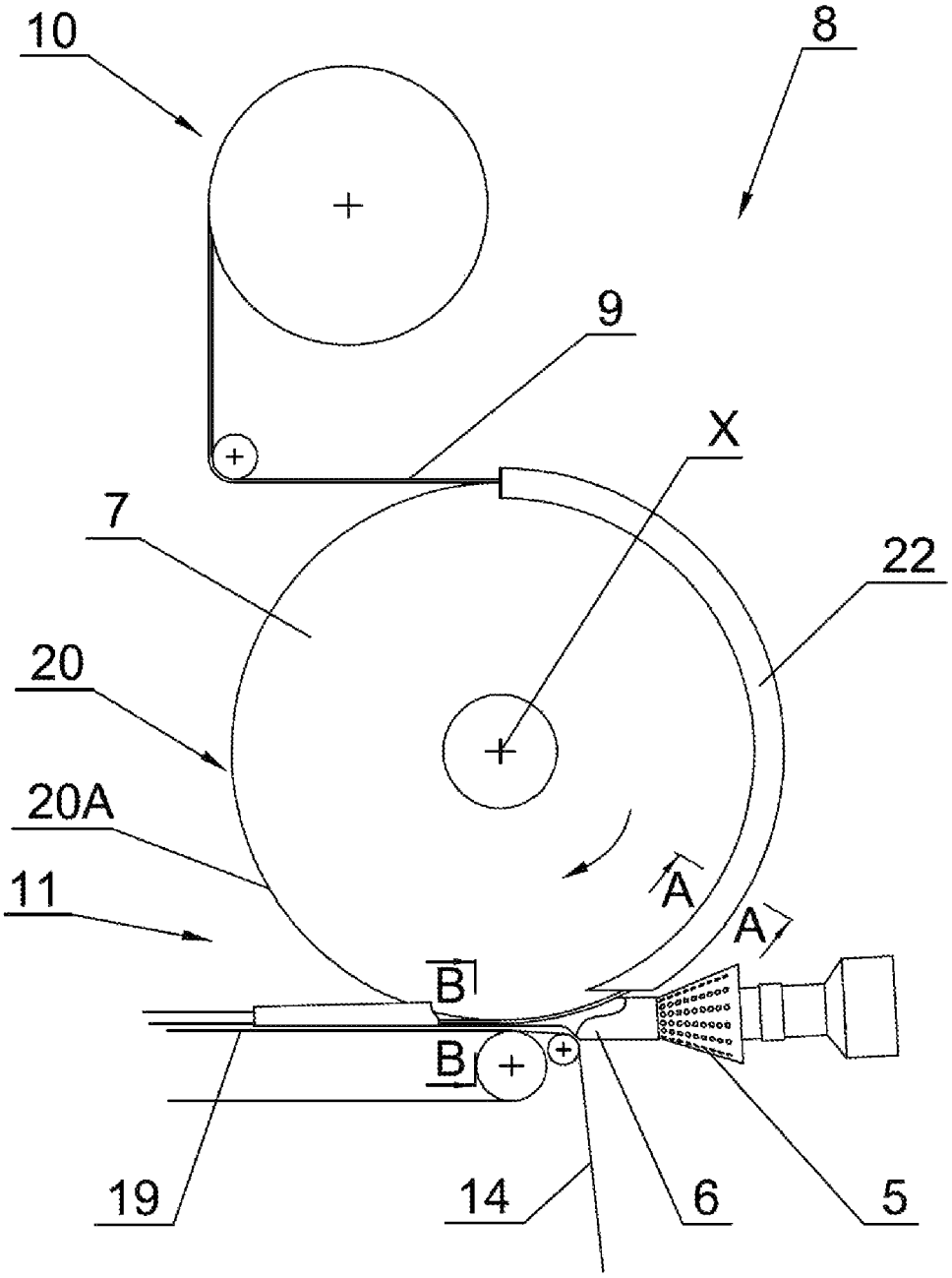
FIG. 2 shows a feeding device according to the invention in a first embodiment.
Figure 3:
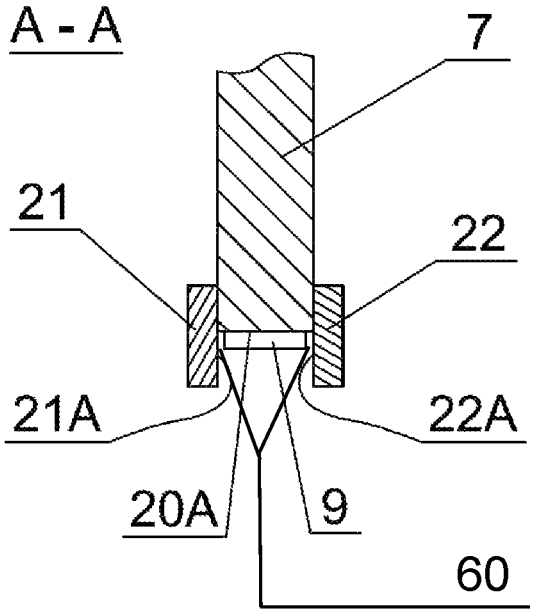
FIG. 3 shows a cross-section of a feeding wheel and strip guides of the feeding device of FIG. 2.
Figure 4:
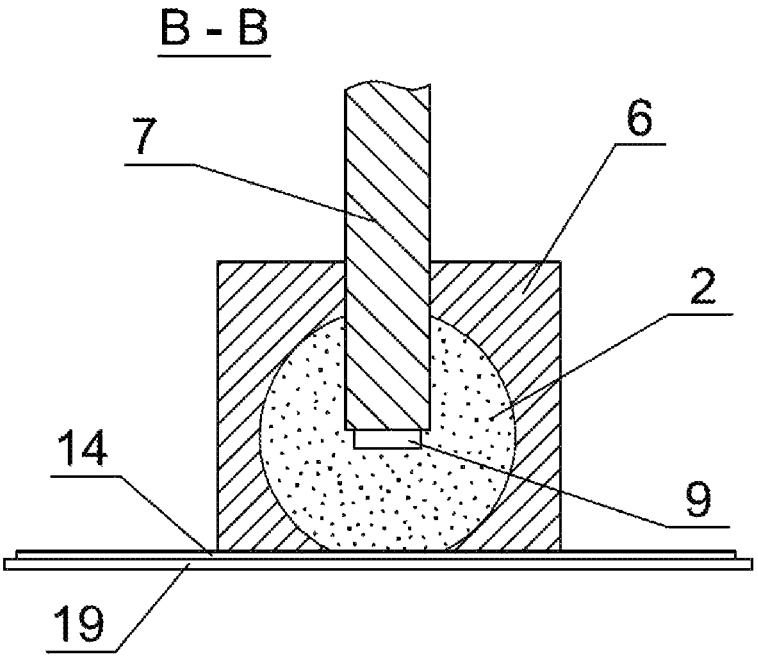
FIG. 4 shows a cross-section of the feeding wheel of the feeding device of FIG. 2 at a point wherein the strip is placed into the fibrous band.

FIG. 2 shows an enlarged view of a first embodiment of the feeding device 8 for feeding the continuous strip 9. The continuous strip 9 is fed from the strip supply unit 10. The strip may be supplied from a reel and fed by any type of strip feeding unit. The feeding device 8 comprises a feeding wheel 7 having a rotation axis X. The circumferential surface 20 of the feeding wheel 7 has a cylindrical guiding surface 20A for guiding the continuous strip 9. The continuous strip 9 may be also guided in alternative ways. The device 8 comprises two stationary guides 21, 22 as shown in the A-A cross-section in enlarged view in FIG. 3. Surfaces 21A, 22A of the guides 21, 22 at the cylindrical guiding surface 20A, form a duct 60 used for guiding the strip 9 and for preventing the strip from slipping away from the cylindrical guiding surface 20A. The guiding surfaces 21A, 22A are substantially perpendicular to the rotation axis X of the feeding wheel 7. The cross-section B-B (FIG. 4) shows the strip 9 being placed into the filtering material band 2. Further on during the movement of the continuous filtering material 2 together with the wrapper 14 on a garniture belt 19, the continuous strip 9 is wrapped by the filtering material 2. In that embodiment, the continuous strip 9 contacts (encircles) the feeding wheel 7 along a half of its cylindrical guiding surface 20A. The large contact angle allows the continuous strip to be fed without slipping, i.e. with a circumferential speed of the feeding wheel 7, which corresponds to the speed of the movement of the band 2.

Figure 5:
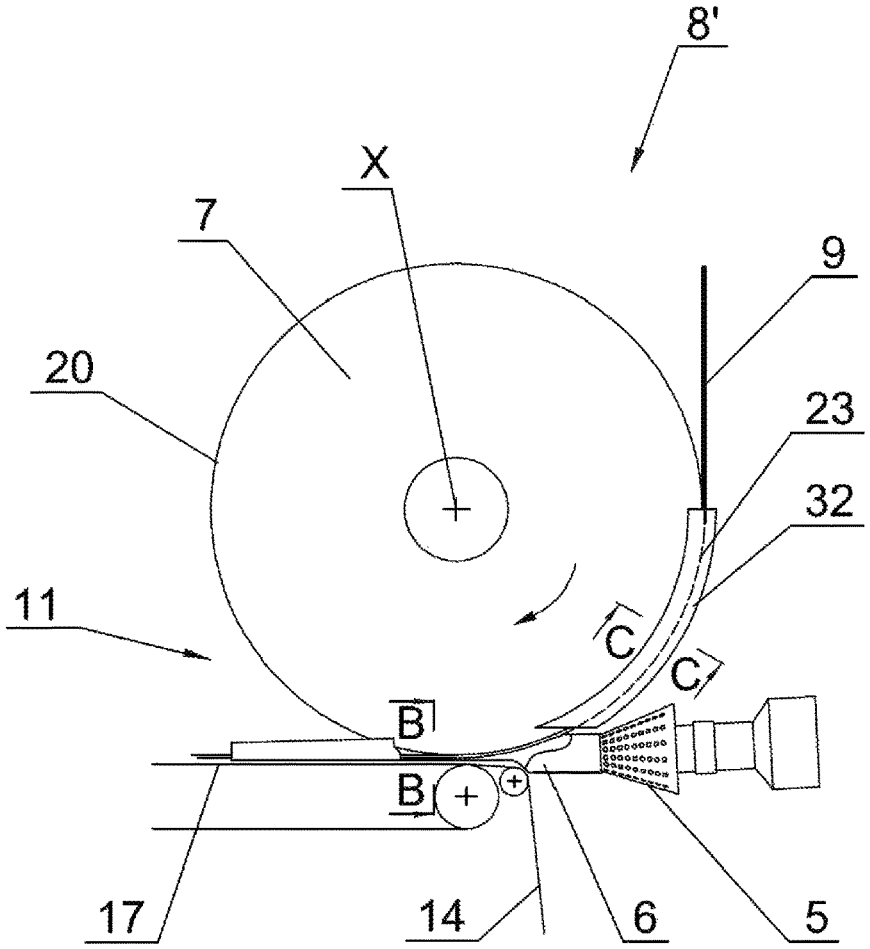
FIG. 5 shows the feeding device according to the invention in a second embodiment.
Figure 6:
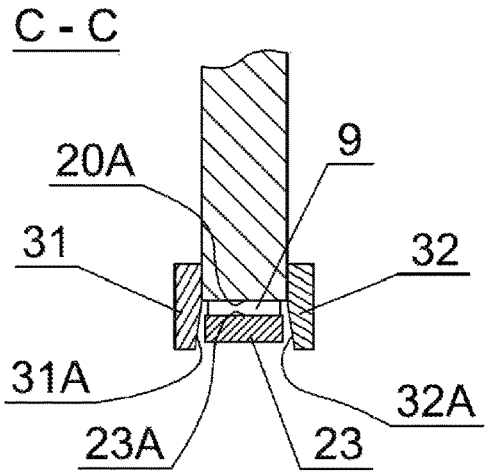
FIG. 6 shows a cross-section of the feeding wheel and the strip guides of the feeding device of FIG. 5.

FIG. 5 shows a second embodiment of the feeding device 8', wherein the supply unit for feeding the continuous strip 9 is not visible. The feeding device 8' comprises two stationary side guides 31, 32 which have guiding surfaces 31A, 32A shown in cross-section C-C in FIG. 6, wherein the guiding surfaces 31A, 32A have a conical shape, which helps to keep the strip on the guiding surface 20A with a limited action of the guiding surfaces 31A, 32A on the edges of the strip 9. The feeding device 8' comprises a stationary guide 23 having a guiding surface 23A, which is a portion of a cylinder. The stationary guide 23 presses the strip 9 against the guiding surface 20A. The stationary guide 23 is located along at least a portion of the length of the side guiding surfaces 31A, 32A, preferably along the whole length thereof.

Figure 7:
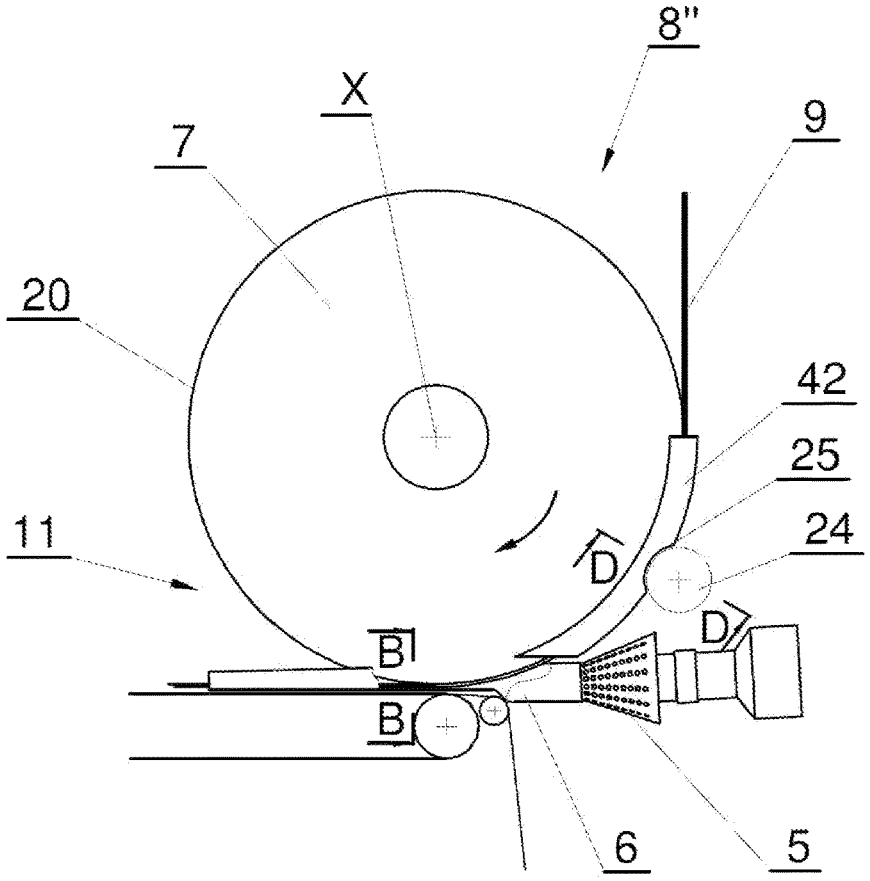
FIG. 7 shows the feeding device according to the invention in a third embodiment.
Figure 8:
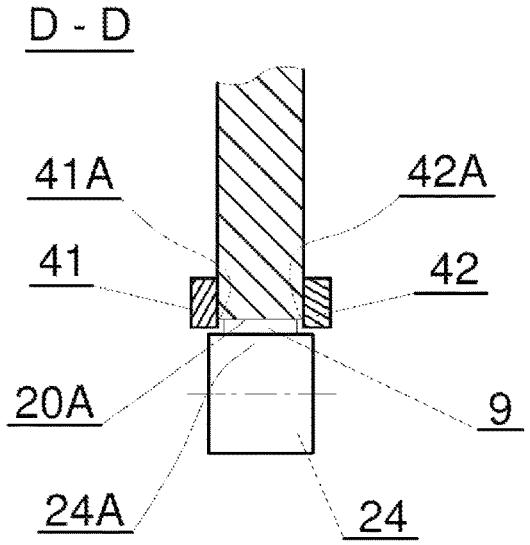
FIG. 8 shows a cross-section of the feeding wheel and the strip guides of the feeding device of FIG. 7.

In a third embodiment shown in FIG. 7, the feeding device 8" comprises two stationary side guides 41, 42 which have guiding surfaces 41A, 42A shown in cross-section D-D in FIG. 8. The feeding device 8" comprises a rotary roller 24, having a cylindrical side surface 24A that forms a guiding surface for the continuous strip 9 and presses the strip 9 against the guiding surface 20A. The guiding surfaces 41A, 42A may have recesses 25 for placing the roller 24.

Figure 9:
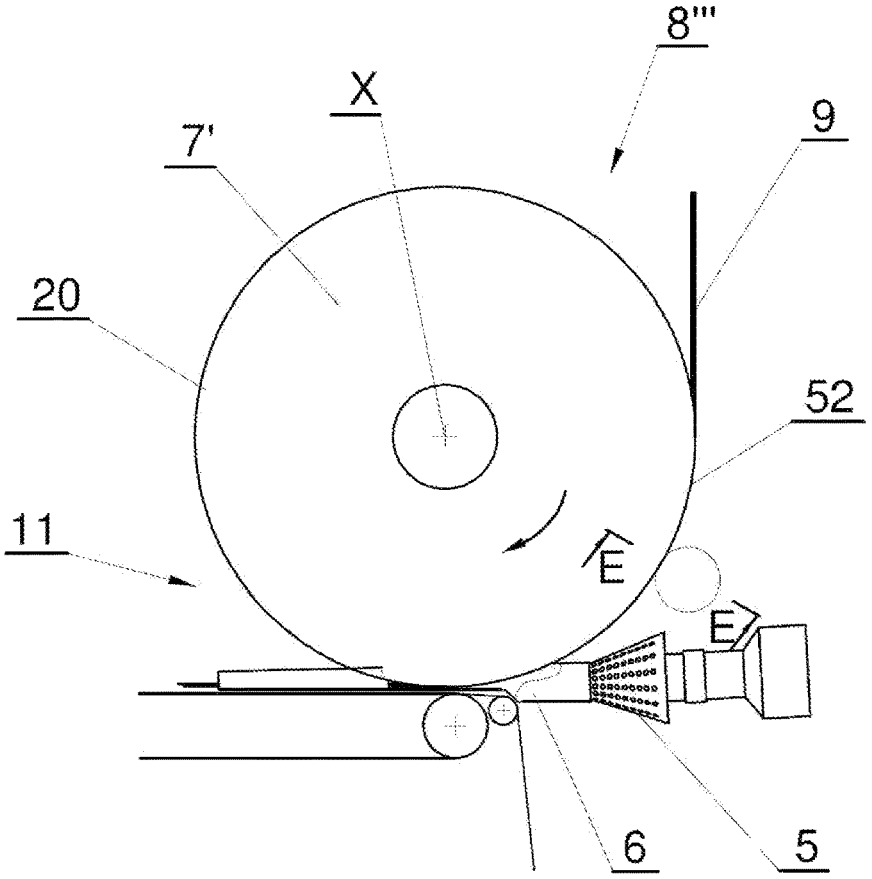
FIG. 9 shows the feeding device according to the invention in a fourth embodiment.
Figure 10:
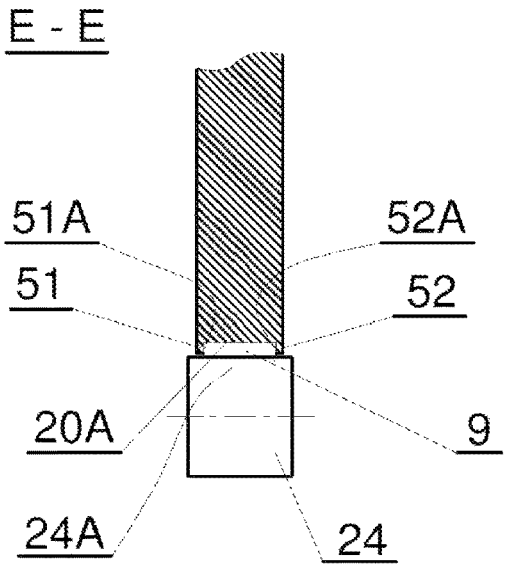
FIG. 10 shows a cross-section of the feeding wheel and the strip guides of the feeding device of FIG. 9.

In a fourth embodiment shown in FIG. 9, the feeding device 8'" comprises a feeding wheel 7' having a groove 51 on its circumferential surface 20, as shown in a cross-section E-E in FIG. 10. The groove has a cylindrical guiding surface 20A and two guiding side surfaces 51A, 52A formed by rims 51, 52.

Figure 11:
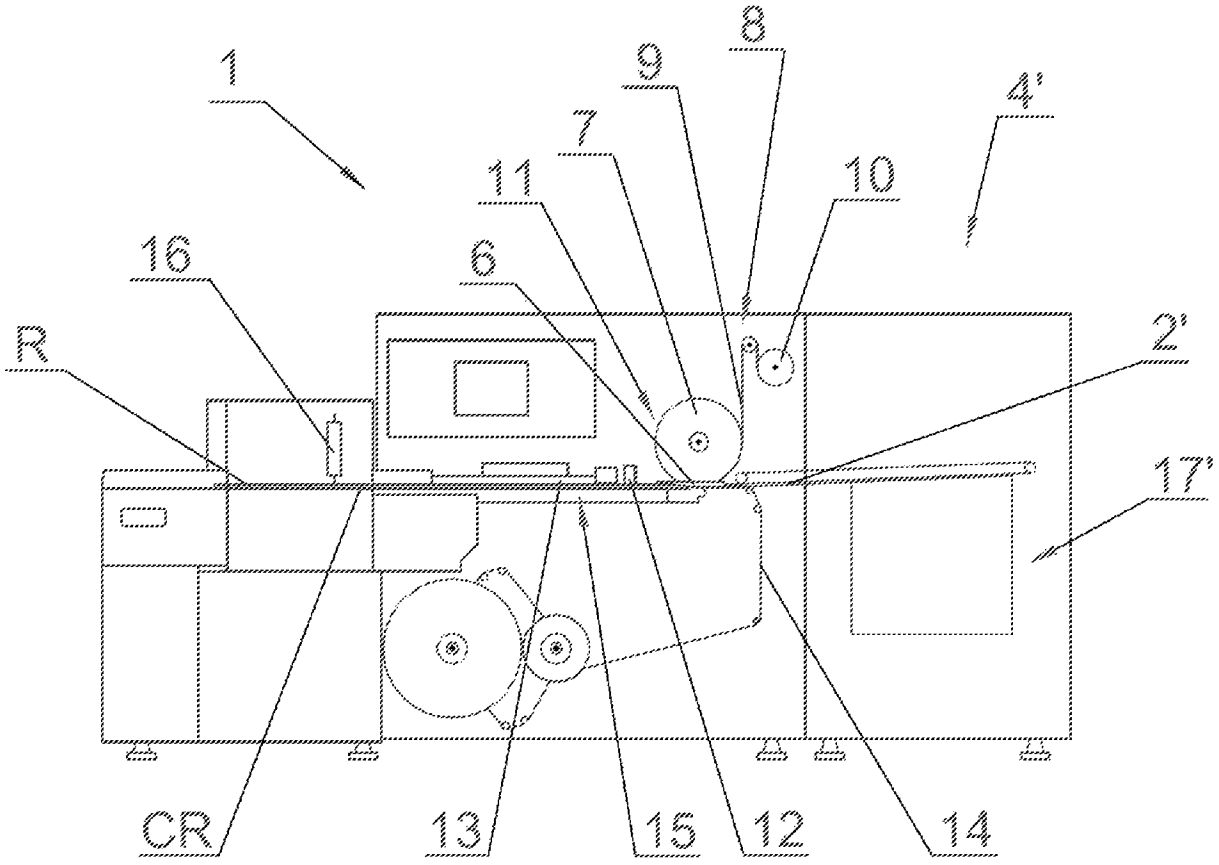
FIG. 11 shows a machine for manufacturing tobacco rods.

FIG. 11 shows a machine for manufacturing rod-like elements from shredded tobacco. The tobacco material is fed by a fibrous band supply unit 17'. A continuous band of tobacco material is fed on the wrapper 14 and passes through the region of operation of the feeding device 8, that feeds the continuous strip 9 into the band of tobacco material.

Further embodiments are possible, that comprise one or more of the features of the embodiments discussed above combined with each other.

The invention claimed is:

1. A feeding device for feeding a continuous strip into a continuous fibrousband, in a tobacco industry machine for manufacturing rod-like elements, forming a continuousrod comprising the continuous strip surrounded by the continuous fibrous band, the feeding device comprising:

a strip supply unit for feeding the continuous strip;

a strip feeding unit for feeding the continuous strip fed from the strip supply unit into a middle of the continuous fibrous band, the strip feeding unit being located in the machine between a fibrous band preparation unit and a garniture unit for forming the continuous rod;

a feeding wheel having a circumferential surface comprising a first cylindrical guiding surface for guiding the continuous strip, wherein the feeding wheel rotates with a circumferential speed corresponding to a speed of movement of the continuous fibrous band;

a first side guiding surface and a second side guiding surface; and a second cylindrical guiding surface in a form of at least one rotary roller located at the first cylindrical guiding surface, wherein the rotary roller presses the strip against the first cylindrical guiding surface;

wherein the first side guiding surface, the second side guiding surface, and the first cylindrical guiding surface form a duct for guiding the continuous strip.

2. The device of claim 1, wherein the first cylindrical guiding surface is a rotary cylindrical guiding surface, and the first side guiding and the second side guiding surface are stationary and positioned at the rotary first cylindrical guiding surface.

3. The device of claim 2, wherein the stationary first side guiding surface and the stationary second side guiding surface are perpendicular to a rotation axis of the feeding wheel.

4. The device claim 3, comprising a third guiding surface in a form of a portion of a cylinder, located in parallel to the first cylindrical guiding surface, wherein the third side guiding surface is stationary.

5. The device of claim 2, wherein the stationary first side guiding and the stationary second side guiding surface are conical.

6. The device claim 5, comprising a third side guiding surface in a form of a portion of a cylinder, located in parallel to the first cylindrical guiding surface.

7. The device claim 2, comprising a third side guiding surface in a form of a portion of a cylinder, located in parallel to the first cylindrical guiding surface, wherein the third side guiding surface is stationary.

8. The device of claim 1, wherein the circumferential surface of the feeding wheel has a circumferential groove configured to guide the continuous strip, the circumferential groove comprising the first cylindrical guiding surface, the first side guiding surface, and the second side guiding surface.

9. The device claim 8, comprising a third side guiding surface in a form of a portion of a cylinder, located in parallel to the first cylindrical guiding surface, wherein the third side guiding surface is stationary.

10. The device of claim 1, comprising a third side guiding surface in a form of a portion of a cylinder, located in parallel to the first cylindrical guiding surface, wherein the third side guiding surface is stationary.

11. A machine for manufacturing rod-like elements, the machine comprising: a fibrous band supply unit for feeding a continuous fibrous band;

a fibrous band preparation unit for preparing the fibrous band; a feeding device for feeding a continuous strip;

a wrapper feeding unit (18) for feeding a wrapper;

a garniture unit for forming a continuous rod, wherein the continuous rod comprises the fibrous band and the continuous strip and is wrapped by the wrapper; and a cutting head for cutting the continuous rod into the rod-like elements; wherein the feeding device comprises i. a strip supply unit for feeding a continuous strip;

ii. a strip feeding unit for feeding the continuous strip fed from the strip supply unit into a middle of the continuous fibrous band, the strip feeding unit being located in the machine between a fibrous band preparation unit and a garniture unit for forming the continuous rod;

iii. a feeding wheel having a circumferential surface comprising a first cylindrical guiding surface for guiding the continuous strip, wherein the feeding wheel rotates with a circumferential speed corresponding to a speed of movement of the continuous fibrous band;

iv. a first side guiding surface and a second side guiding surface; and v. a second cylindrical guiding surface in a form of at least one rotary roller located at the first cylindrical guiding surface, wherein the rotary roller presses the strip against the first cylindrical guiding surface;

vi. wherein the first side guiding surface, the second side guiding surface, and the first cylindrical guiding surface form a duct for guiding the continuous strip.

12. The machine of claim 11, wherein the first cylindrical guiding surface is a rotary cylindrical guiding surface,_ and the first side guiding surface and the second side guiding surface are stationary side guiding surfaces positioned at the rotary first cylindrical guiding surface.

13. The device of claim 12, wherein the stationary side guiding surfaces are perpendicular to a rotation axis of the feeding wheel.

14. The device claim 13, comprising a third side guiding surface in a form of a portion of a cylinder, located in parallel to the first cylindrical guiding surface, wherein the third side guiding surface is stationary.

15. The device of claim 12, wherein the stationary side guiding surfaces are conical.

16. The device claim 15, comprising a third side guiding surface in a form of a portion of a cylinder, located in parallel to the first cylindrical guiding surface, wherein the third side guiding surface is stationary.

17. The device of claim 11, wherein the circumferential surface of the feeding wheel has a circumferential groove configured to guide the continuous strip, the circumferential groove comprising the first cylindrical guiding surface, and the first side guiding surface, and the second side guiding surface.

18. The device claim 17, comprising a third side guiding surface in a form of a portion of a cylinder, located in parallel to the first cylindrical guiding surface, wherein the third side guiding surface is stationary.

19. The device claim 11, comprising a third side guiding surface in a form of a portion of a cylinder, located in parallel to the first cylindrical guiding surface, wherein the third side guiding surface is stationary.

20. The device of claim 11, comprising a third side guiding surface in a form of a portion of a cylinder, located in parallel to the first cylindrical guiding surface, wherein the third side guiding surface is stationary.

* * * * *